US006011342A

United States Patent [19]

Walther

[11] Patent Number: 6,011,342

[45] Date of Patent: Jan. 4, 2000

[54] CARBON BRUSH FOR AN ELECTRIC MACHINE

[75] Inventor: Bernd Walther, Bietigheim-Bissingen, Germany

[73] Assignee: ITT Manufacturing Enterprises, Inc., Wilmington, Del.

[21] Appl. No.: 09/095,912

[22] Filed: Jun. 11, 1998

[30] Foreign Application Priority Data

Jun. 13, 1997 [DE] Germany ..... 197 25 082

[51] Int. Cl.[7] ..... H01R 39/38

[52] U.S. Cl. ..... 310/244; 310/242; 310/239; 310/249; 310/238; 310/245

[58] Field of Search ..... 310/244, 242, 310/239, 249, 238, 245

[56] References Cited

U.S. PATENT DOCUMENTS

| | | | |
|---|---|---|---|
| 1,116,492 | 11/1914 | Sammarone | 310/244 |
| 1,293,038 | 2/1919 | Clark | 310/249 |
| 2,906,939 | 9/1959 | Rice | 310/244 |
| 5,053,665 | 10/1991 | Yamaguchi et al. | 310/239 |
| 5,329,198 | 7/1994 | Schmidt et al. | 310/247 |

FOREIGN PATENT DOCUMENTS

| | | |
|---|---|---|
| 225978 | 10/1986 | European Pat. Off. . |
| 3722466 | 1/1988 | Germany . |
| 3725580 | 2/1988 | Germany . |

*Primary Examiner*—Clayton LaBalle
*Assistant Examiner*—Thanh Lam
*Attorney, Agent, or Firm*—J. Gordon Lewis

[57] ABSTRACT

A carbon brush for an electric machine, resiliently acting on a collector, is arranged within a guideway so as to be movable radially to the collector and is inflexibly connected with a bending leg. The carbon brush allows easy and cost-saving assembly in a motor and electric contacting. The bending leg serves the resilient advance of the carbon brush towards the collector, on the one hand, and the electric power supply, on the other hand.

8 Claims, 1 Drawing Sheet

CARBON BRUSH FOR AN ELECTRIC MACHINE

BACKGROUND OF THE INVENTION

This invention relates to a carbon brush for an electric machine, which carbon brush resiliently acts on a collector.

There is already known a great number of various versions of carbon brushes for electric machines. Within a guideway, the so-called brush holder, these carbon brushes are basically arranged so as to be movable radially to the collector which they resiliently act upon. The necessary resiliency is provided by a helical spring which is arranged in alignment with and, relative to the collector, behind the carbon brush. On the side of the brush holder, the carbon brush is generally supported on a wall, e.g., on a bent plate. Separate stranded conductors serve the electric power supply to the carbon brushes. These stranded conductors have to be connected separately in an electrically conductive manner to a power lead. Contacting the flexible stranded conductors to the power lead is a problem in so far as it always takes a great effort to bring the end of the stranded conductor into the desired position. This procedure is not suitable for a cost-saving and, hence, fully automatized assembly with a low percentage of refuse.

Admittedly, resilient brackets with brushes fixed on their ends have already become known which also transport current to the carbon brush so that there is no need for complicated and expensive contacting by means of a stranded conductor. An essential disadvantage of these brush brackets, however, is that, as wear increases, the end of the bracket, together with the brush, will describe a more or less circular movement resulting in oblique abrasion of the carbon brush. Further, in operation, there is a continuous change in the decisive, current-transmitting contact surface. Finally, in operation, the brackets will be caused to vibrate which can imply interruptions in electric power supply.

It is an object of the present invention to provide a carbon brush which will allow easy and cost-saving assembly and which, on the other hand, will ensure the required safety against interruptions in electric power supply.

1. It has been found out that this object is solved by a carbon brush radially movable with respect to the collector and inflexibly connected with a bending leg. It is of advantage that the spring-like leg is connected with the carbon brush so that there is no need for the supply and mounting of a separate spring on the motor assembly line. Further, the carbon brush is reliably guided radially to the collector and, in particular, there will be no oblique abrasion.

Any further advantages and further developments of this invention will become evident from the description of the drawings. In the following, this invention will be described in more detail with reference to one example of an embodiment represented in the drawing.

DETAILED DESCRIPTION OF THE DRAWINGS

Figure 1:
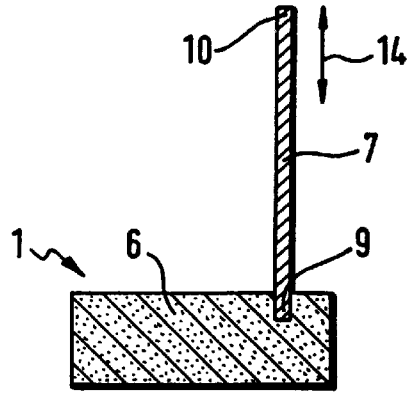
FIG. 1 is a section taken through an inventive carbon brush.

A carbon brush 1 serves the electric power supply to windings arranged on a rotor of an electric machine and resiliently acts on a collector 2. Radially movably to the collector 2, each carbon brush 1 is arranged within a channel-type guideway 3 of guide elements 4, 5. As shown in FIG. 1, the body 6 of each carbon brush 1 is connected with a bending leg 7. The bending leg 7 extends at right angles to an axis of motion 8 of the carbon brush 1 which extends radially to the collector 2. The carbon-brush-side leg end 9 of the bending leg 7 is inflexibly arranged on the body 6 and, e.g., positively engages the body 6. To this end, the leg end 9 can be provided with undercuts. Quite generally, within the guideway 3, the bending leg 7 is movable radially to the collector 2, together with the carbon brush 1, while the other leg end 10 is firmly supported relative to the carbon brush 1. The leg end 10, for instance, is welded to a fixed arm 11. However, a firm contact will already be sufficient for functioning so that the required resiliency will be available when carbon brush 1 abuts on collector 2. In this context, it is to be pointed out that the arm 11 is a part of the brush holder formed by the guide elements 4, 5 or may be a part of a holding plate 12. As further shown by FIGS. 2 and 3, an electric power supply element 13 is connected in an electrically conductive manner with the leg end 10. Thus, at the same time, the bending leg 7 serves the electric power supply to carbon brush 1 so that, within the scope of mechanically fastening the leg end 10 to the arm 11, it is possible to simultaneously effect electric contacting with the supply element 13. Of course, it has to be ensured that the electric transition resistance between the bending leg and the body 6 is as low as possible. Thus, the carbon brush 1 and the bending leg 7 form a one-piece unit, with the bending leg 7 in addition being electrically conductive and serving the electric power supply to the carbon brush 1. The bending leg 7 is fastened to the arm 11 in an inactive end position which is sketched out in FIG. 2 and which is similar to the position of the worn carbon brush 1 in FIG. 3. Means which are basically known and which are to retain the carbon brushes in the biassed end position are not represented in the drawings of the Figures.

Figure 2:
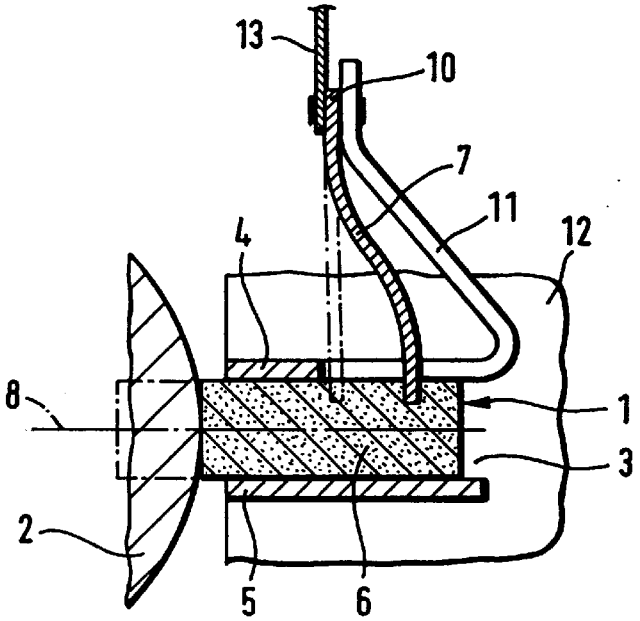
FIG. 2 is a schematic section taken through the carbon brush and a holder in the operating position.
Figure 3:
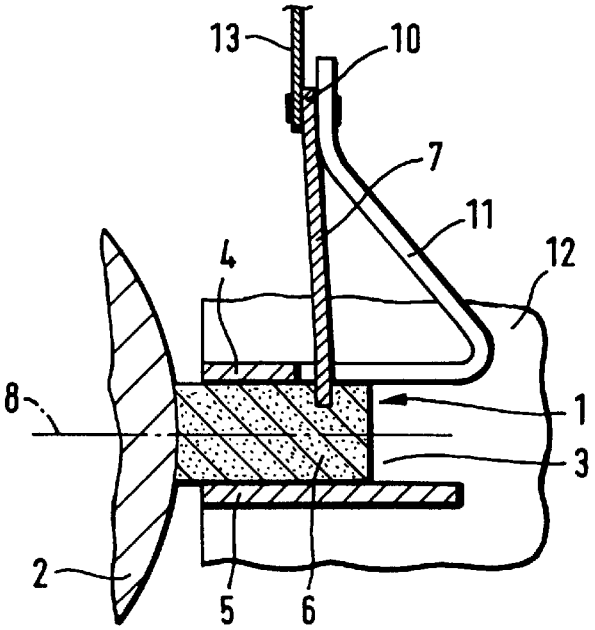
FIG. 3 is a section as in FIG. 2 in an inactive end position of the carbon brush.

Proceeding from the initial position represented in FIG. 2 wherein the bending leg 7 is deflected as much as possible and wherein the body 6 has its initial length free from wear, the bending leg 7 will approach the inactive end position, drawn in FIG. 3, as the wear of the body 6 increases. In this inactive end position, the bending leg 7 will be at right angles to the axis of motion 8.

It remains to be added that an elasticity of the bending leg 7 along the longitudinal direction 14 thereof will increase the resiliency and thus the efficiency of the spring. Hence, it follows that the bending leg 7 can also be combined with an area acting as a compression-tension spring. It will further be of advantage if, in addition to a good resiliency, the material of the bending leg also ensures a good electric conductivity so that there will be little electric losses.

Manufacture of the carbon brush 1 is as follows:—At first, a certain amount of graphite material will be portioned for body 6 and filled into a mould wherein there will already be disposed the bending leg 7 as an insert. Or else, the bending leg will be inserted into the mould in a second working operation. Then, the body will be pressed at high pressure and, if necessary, at increased temperature. This will be followed by a thermal treatment, the sintering process, of the entire carbon brush 1 at approximately 450/C. Finally, the brush will be sized and, if necessary, provided with a grinding radius.

I claim:

1. A carbon brush for an electric machine, which carbon brush resiliently acts on a collector, wherein, within a guideway, the carbon brush is arranged so as to be moveable radially to the collector and is inflexibly connected with a bending legs, the bending leg resiliently biasing the carbon brush radially toward the collector and electrically conducting an electric power supply to the carbon brush.

2. A carbon brush as claimed in claim 1, wherein a first, brush-side, leg end of the bending leg is radially movable together with the carbon brush and wherein a second leg end is fixed relative to the carbon brush.

3. A carbon brush as claimed in claim 2, wherein the bending leg positively engages a body of the carbon brush by means of the first leg end.

4. A carbon brush as claimed in claim 3, wherein the body and the bending leg form a one-piece unit.

5. A carbon brush as claimed in claim 2, wherein the second leg end of the bending leg is electrically conductive.

6. A carbon brush as claimed in claim 2, wherein, at the second end, the bending leg is connected with an electric power supply element.

7. A carbon brush as claimed in claim 1, wherein the bending leg has a maximum deflection with maximum resiliency in an initial position when the carbon brush is new, and wherein it approaches an inactive end position with an increasing wear of the carbon brush.

8. A procedure for manufacturing a carbon brush, wherein one leg end of a bending leg is pressed into a body of a carbon brush.

* * * * *